US006571496B2

(12) United States Patent
Zarelius

(10) Patent No.: US 6,571,496 B2
(45) Date of Patent: Jun. 3, 2003

(54) PORTABLE VISUAL DISPLAY DEVICE WITH REMOVABLE CASSETTE

(75) Inventor: Christer Zarelius, Stockholm (SE)

(73) Assignee: Expand International of America, Inc., Fairfield, CT (US)

( * ) Notice: Subject to any disclaimer, the term of this patent is extended or adjusted under 35 U.S.C. 154(b) by 0 days.

(21) Appl. No.: 09/919,366

(22) Filed: Jul. 30, 2001

(65) Prior Publication Data

US 2002/0050083 A1 May 2, 2002

(30) Foreign Application Priority Data

Aug. 31, 2000 (SE) ..... 00-1575

(51) Int. Cl.[7] ..... G09F 11/18

(52) U.S. Cl. ..... 40/514; 40/517

(58) Field of Search ..... 40/601, 610, 499, 40/514, 515, 516, 517; 70/515; 160/238, 323.1, 324, 325, 326, DIG. 10

(56) References Cited

U.S. PATENT DOCUMENTS

| | | | | |
|---|---|---|---|---|
| 464,030 A | * | 12/1891 | Ludgin | 40/517 |
| 1,364,223 A | * | 1/1921 | Venard | 40/517 |
| 1,700,637 A | * | 1/1929 | Lamb | 160/323.1 |
| 4,694,601 A | | 9/1987 | Dicke et al. | |
| 4,794,715 A | * | 1/1989 | Cherwin | 40/514 |
| 4,875,302 A | | 10/1989 | Noffsinger | |
| 5,362,020 A | | 11/1994 | Brown | |
| 6,012,688 A | | 1/2000 | LaMotte | |
| 6,115,951 A | * | 9/2000 | Jing et al. | 40/610 |

* cited by examiner

*Primary Examiner*—D. Glenn Dayoan
*Assistant Examiner*—Jason Morrow
(74) *Attorney, Agent, or Firm*—Ohlandt, Greeley, Ruggiero & Perle, L.L.P.

(57) ABSTRACT

There is provided a visual display device that has a holding member, a cassette that can be removably inserted into and removed from the holding member and an arrangement for displaying a banner, photomural display panel or other display media. There is also provided a mechanism in the cassette for holding the banner, photomural display panel or other visual display media.

27 Claims, 8 Drawing Sheets

PORTABLE VISUAL DISPLAY DEVICE WITH REMOVABLE CASSETTE

CROSS REFERENCE TO RELATED APPLICATIONS

The present application is a continuation-in-part of U.S. Des. Patent Application Ser. No. 29/137,693, filed Feb. 26, 2001 and claims priority of Swedish Patent Application No. 00-1575, filed Aug. 31, 2000.

BACKGROUND OF THE INVENTION

1. Field of the Invention

The present invention relates to portable visual display devices. More particularly, the present invention relates to a portable visual display device that utilizes a removable cassette to display a banner, advertising material or other visual display media.

2. Description of the Prior Art

Portable visual display devices have a variety of applications. For example, they can be used to display advertising material. Such devices are commonly used by exhibitors to display marketing materials in trade shows and exhibitions.

There are many different types of visual display devices available. These devices include simple stands that are utilized to hold rigid-type displays, as well as devices that are used to display flexible media.

There often exists a need to provide a temporary or portable device for displaying a photomural or other information carrying banner or sign that is readily deployed to support and display a relatively large sign and yet is lightweight and easily carried for transport and storage. Such a device would find advantageous use in retail sales displays, trade shows, fairs or the like to provide a variety of information to those in view of it. Certain types of signs have been devised that are portable and some are also collapsible. One such device is disclosed by U.S. Pat. No. 4,694,601 to Dicke et al in which a sign panel is secured to a frame having four arms pivotally attached to a rigid central web. The four arms extend to form a cross bracing structure to hold the sign and are designed to fold down in one direction when collapsed.

Other folding signs are shown in U.S. Pat. No. 4,875,302 to Noffsinger and U.S. Pat. No. 5,362,020 to Brown. Noffsinger discloses a portable, collapsible display sign in which hinged leg supports adjust legs from a collapsed position to a fully extended spread or open position by a slidable frame member. The sign is in the form of a stretchable elastic fabric secured to the frame and each respective leg support such that tension in the fabric maintains the display in the open position in a two-sided system.

In Brown, pairs of pivotal legs are attached to a common cross member and are adapted to swing between fully folded and fully deployed positions.

Still another collapsible display system is disclosed in U.S. Pat. No. 6,012,688 to LaMotte. That device incorporates a pair of spaced hollow mounting tubes, which carry opposite edge loops of the banner threaded over the tubes. In such an assembled system, the banner is carried on and between the spaced apart mounting rods. The banner is held in tension by a pair of hollow strut members crossed to form an X-bracing arrangement.

While these and other existing devices have certain attributes and provide a degree of flexibility and portability in successful display signs, there remains a need for a lightweight, durable, portable system that readily deploys from a storage state to a display mode readily. There also exists a need for such a system in which many different banners or murals can be interchangeably displayed using the same device without the need to disassemble the device for banner loading purposes. In addition, there exists the need for such a device, in which the displayed banner or mural can easily be retracted, removed from the display, and replaced with another banner or mural.

SUMMARY OF THE INVENTION

It is an object of the present invention to provide a lightweight, durable, readily deployed display support system for a banner, photomural display panel or other visual display media.

It is another object of the present invention to provide such a lightweight, durable, readily deployed display support system for a banner, photomural display panel or other visual display media in which the banner, photomural display panel or other visual display media can readily and easily be exchanged relative to the support structure.

It is a further object of the present invention to provide for the easy and convenient exchange of banners, photomural display panels or other visual display media relative to the support structure through the use of a removable cassette that can be readily loaded into and removed from the support structure.

These and other objects and advantages of the present invention are achieved by inserting and securing into a holding member a removable cassette that has been preloaded with a banner, photomural display panel or other visual display media, and then extending the banner, photomural display panel or other visual display media from the holding member. The cassette can receive a display media and is adapted to be inserted into and removed from the holding member. It is designed to permit movement of the display media from a closed position to an open, visual position. There is also a mechanism for removably positioning the cassette into the holding member and a second mechanism for maintaining the display media in the open position. dr

DESCRIPTION OF THE INVENTION

Figure 1:
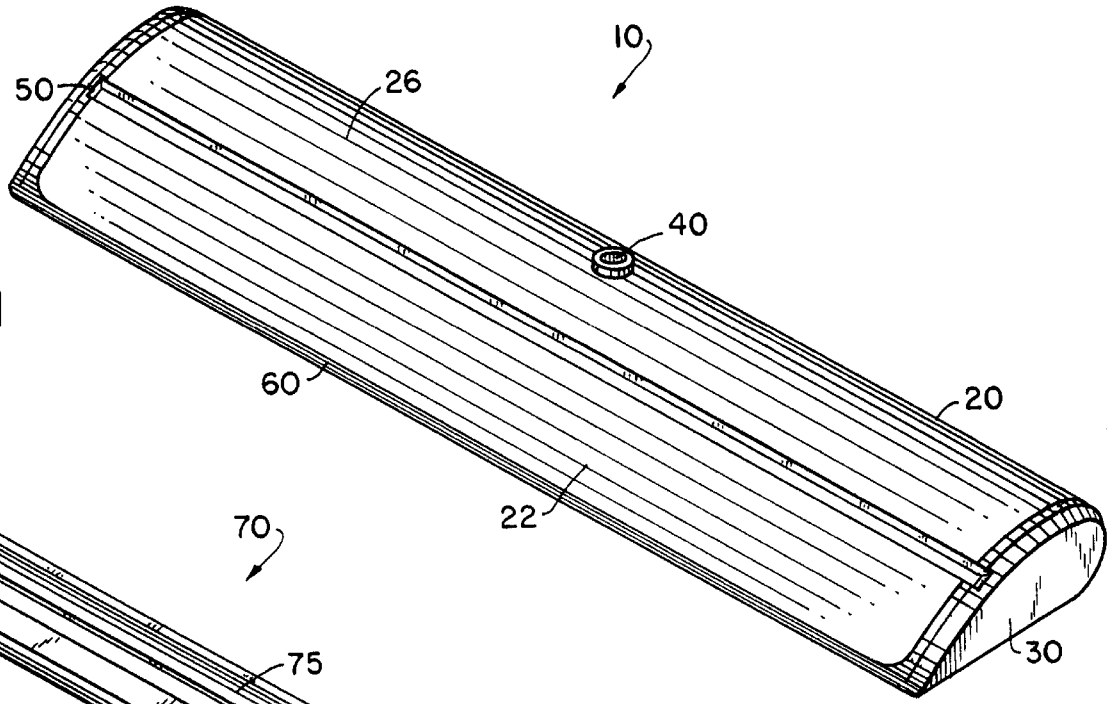
FIG. 1 is a perspective view of the visual display device of the present invention.
Figures 2, 3:
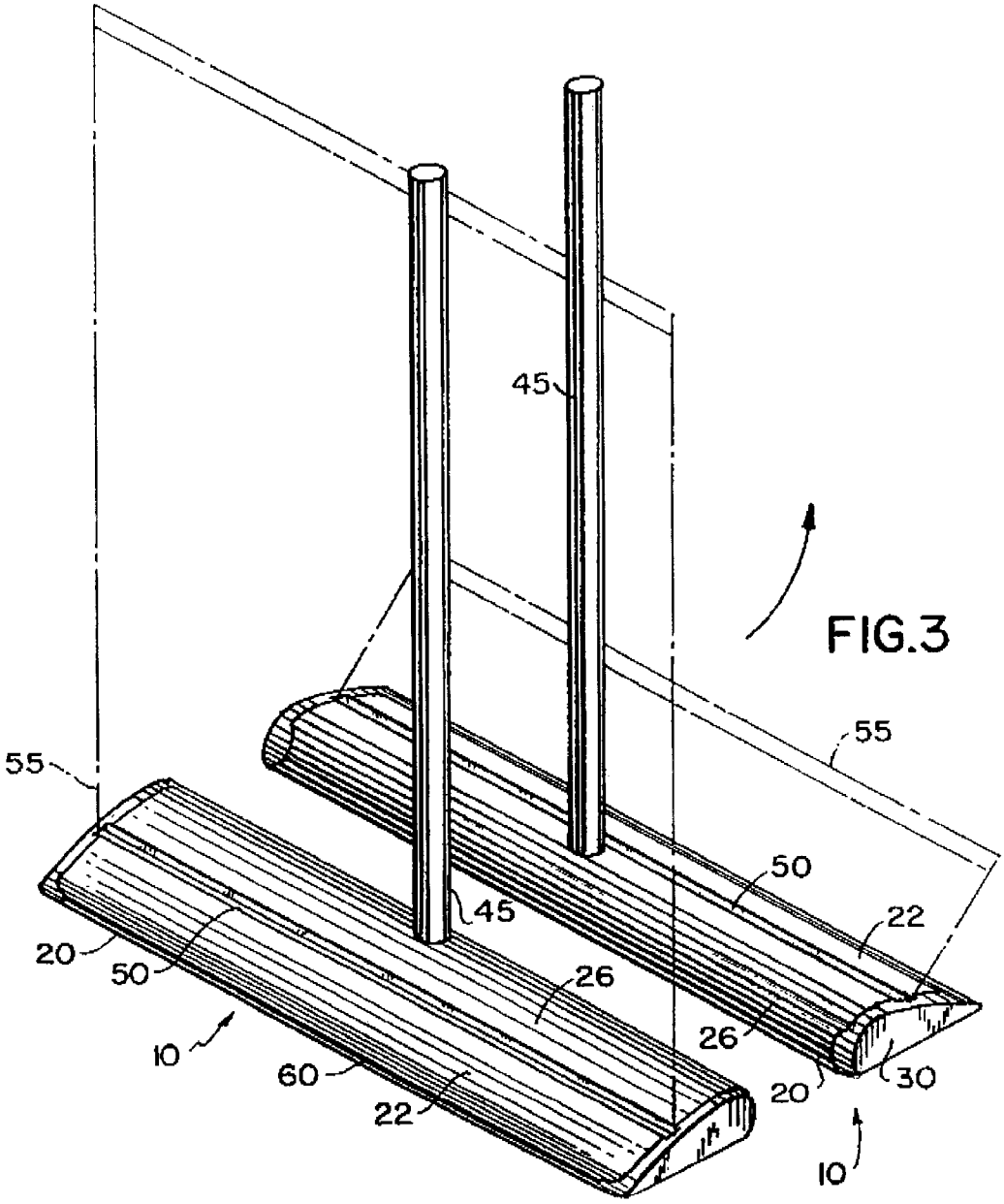
FIG. 2 is a front perspective view of the visual display device of FIG. 1, with a pole connected to the device and banner shown in phantom.
FIG. 3 is a rear perspective view of the visual display device of FIG. 1, with a pole connected to the device and banner shown in phantom.

Referring to the drawings and, in particular, FIGS. 1 to 3, there is shown a visual display device generally represented by reference numeral 10. FIG. 1 shows display device 10 in its closed position, while FIGS. 2 and 3 show display device 10 in its open position.

Visual display device 10 has a base or holding member 20. Holding member 20 has a first portion 22 and a second portion 26 separated by an opening 50 running longitudinally along its top surface. Second portion 26 has an orifice 40. First portion 22 preferably has a strip 60. In the preferred embodiment shown in FIGS. 1 to 3, the holding member 20 has sides that are each generally elliptical in shape. Holding member 20 is preferably made of a lightweight and durable material such as aluminum. As shown in FIGS. 2 and 3, a banner, photomural display panel or other visual display media 55 can be extended or retracted from holding member 20, and thus the cassette 70, through opening 50 in the holding member.

Figure 4:
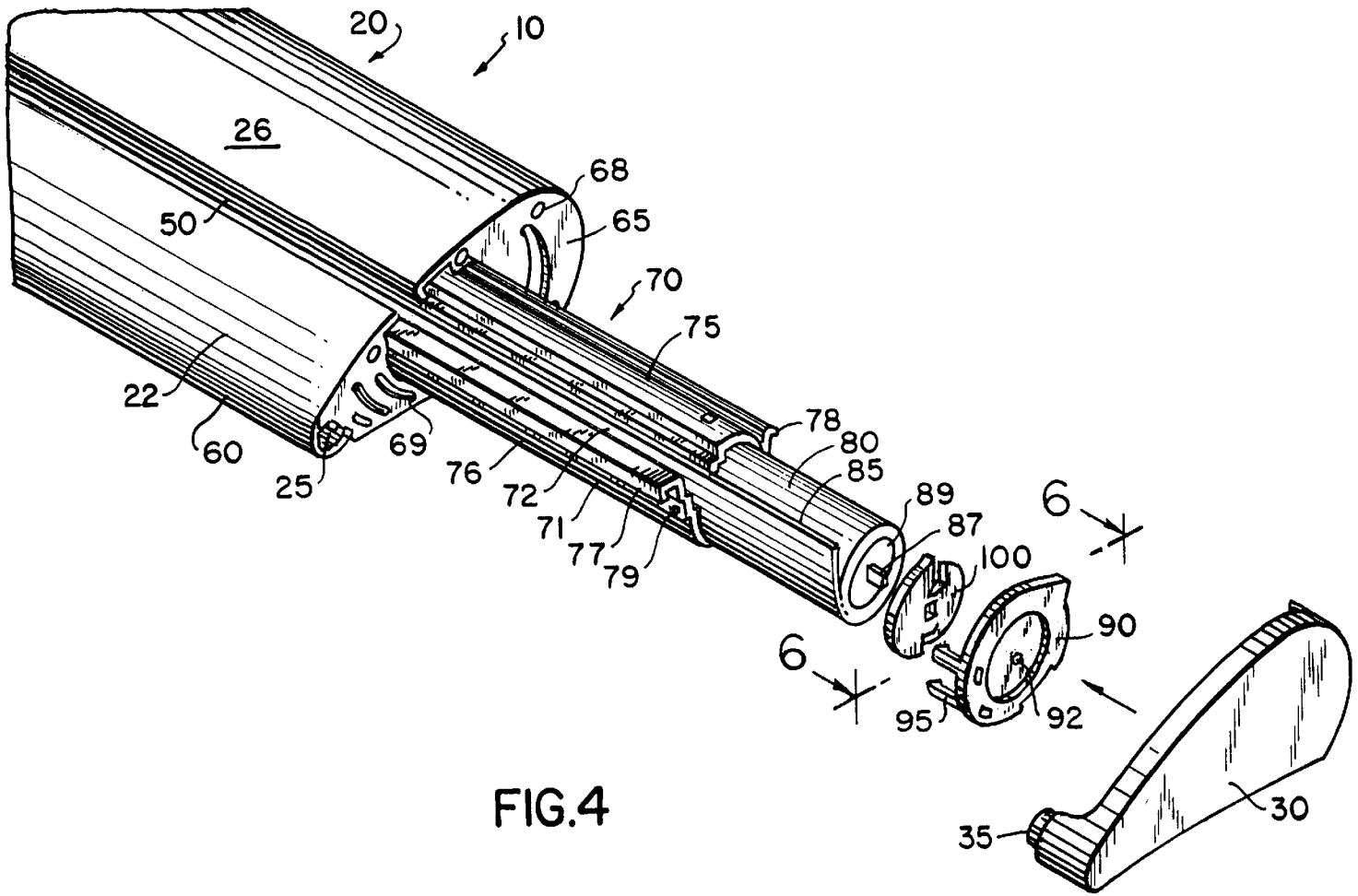
FIG. 4 is an exploded view of an end portion of the visual display device of FIG. 1.
Figure 5:
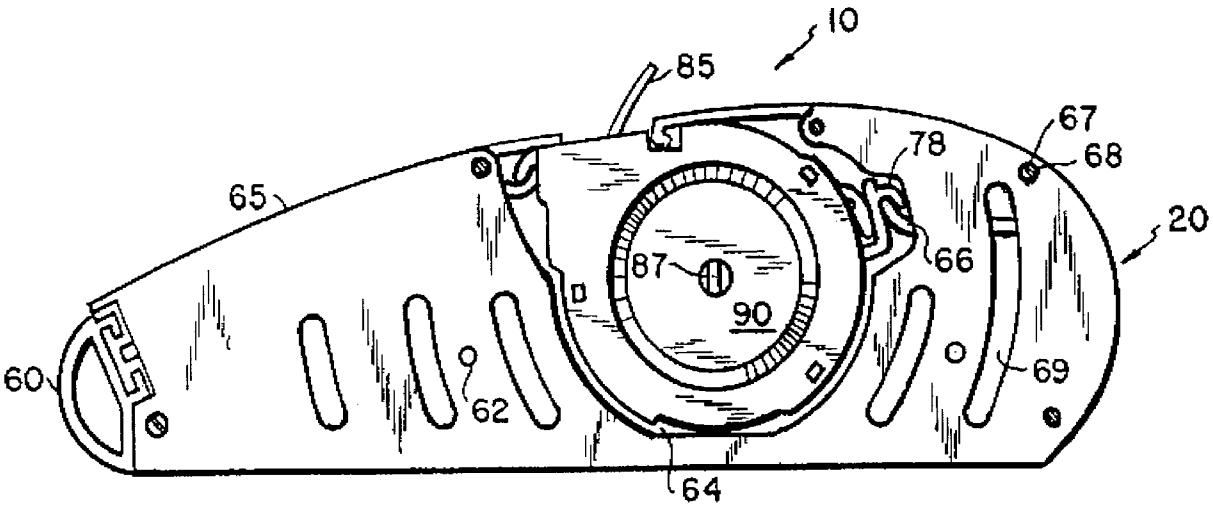
FIG. 5 is a side view of the visual display device of FIG. 1, with a side element attached and with a cassette inserted.
Figure 10:
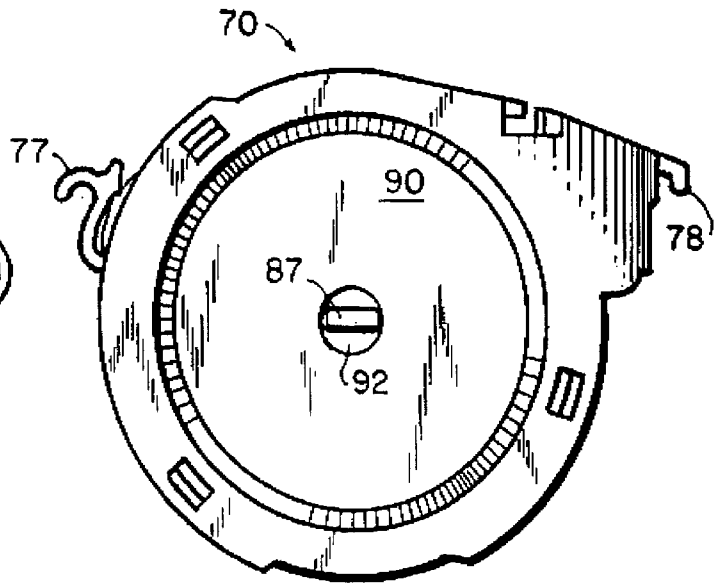
FIG. 10 is a side view of a cassette for the visual display device of FIG. 1.
Figure 7:
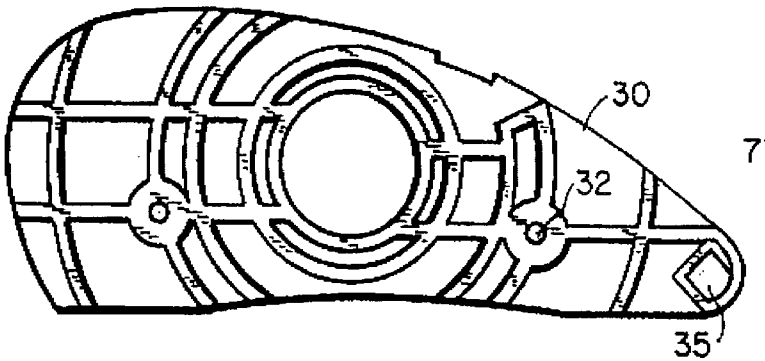
FIG. 7 is an interior view of a side covering for the visual display device of FIG. 1.
Figure 15:
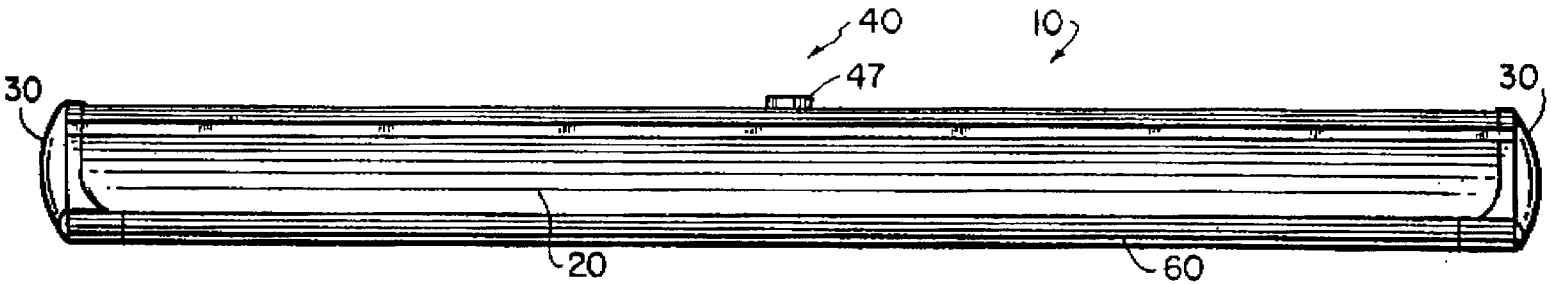
FIG. 15 is a front view of the visual display device of FIG. 1.

As shown in FIG. 4, holding member 20 of visual display device 10 preferably has two side elements 65 (only one of which is shown). Each side element 65 is connected to a different end of holding member 20. In the preferred embodiment shown in FIGS. 4 and 5, each side element 65 is connected to holes 68 of the body of holding member 20 by screws 67. Each side element 65 preferably also has at least one open slot 69. A side covering 30 is preferably removably attached to each side element 65. Referring to FIGS. 4 and 5, at least one side covering 30 has holes 32 shown in FIG. 7, which line up with holes 62 in side element 65, and which is attached thereto preferably by removable thumbscrews. Each removable side covering 30 is preferably made of a plastic material.

Figure 6:
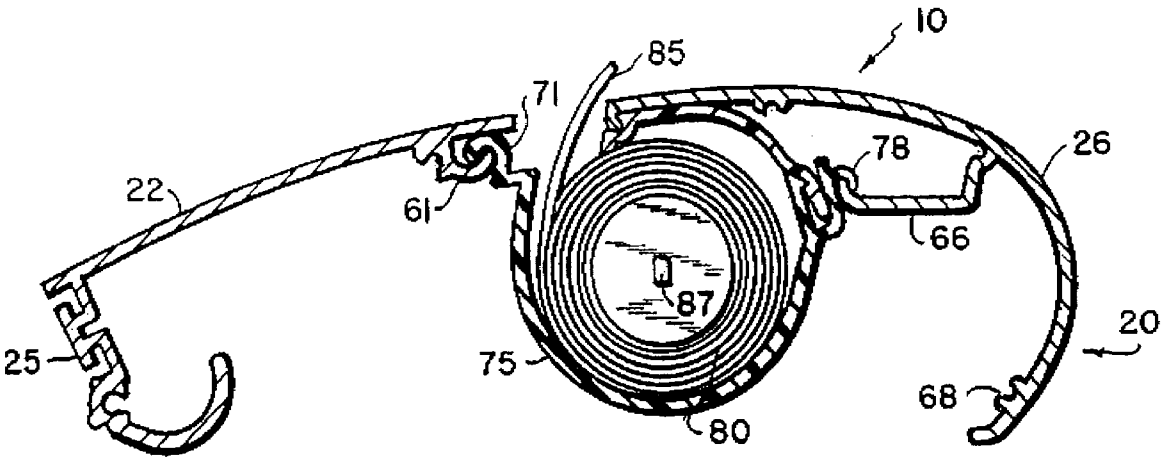
FIG. 6 is a side cross-sectional view taken along lines 6-6 of FIG. 4.

As shown in FIG. 5, each side element 65 of the holding member 20 has a centrally located opening 64, through which the cassette member 70 can be inserted into holding member 20. As shown in FIGS. 5 and 6, holding member 20 has ridged members 61 and 66 in its interior that hook onto and hold the removable cassette member 70.

As shown in FIG. 6, the front of the holding member 20 has a grooved element 25 running along its length in which strip 60 is attached. Strip 60 is preferably a curved, plastic strip. FIG. 4 shows that the removable side coverings 30 have protrusions 35 that line up with the plastic strip 60 and allow for an aesthetically pleasing uniform appearance on the front side of the holding member 20.

Figure 8:
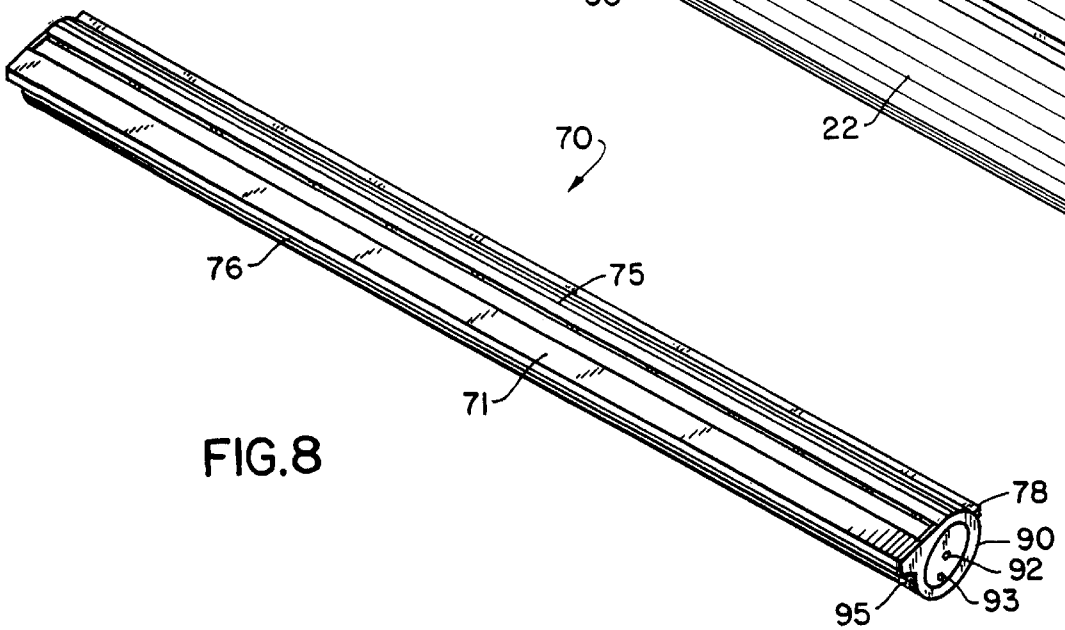
FIG. 8 is a perspective view of a cassette for the visual display device of FIG. 1.
Figure 9:
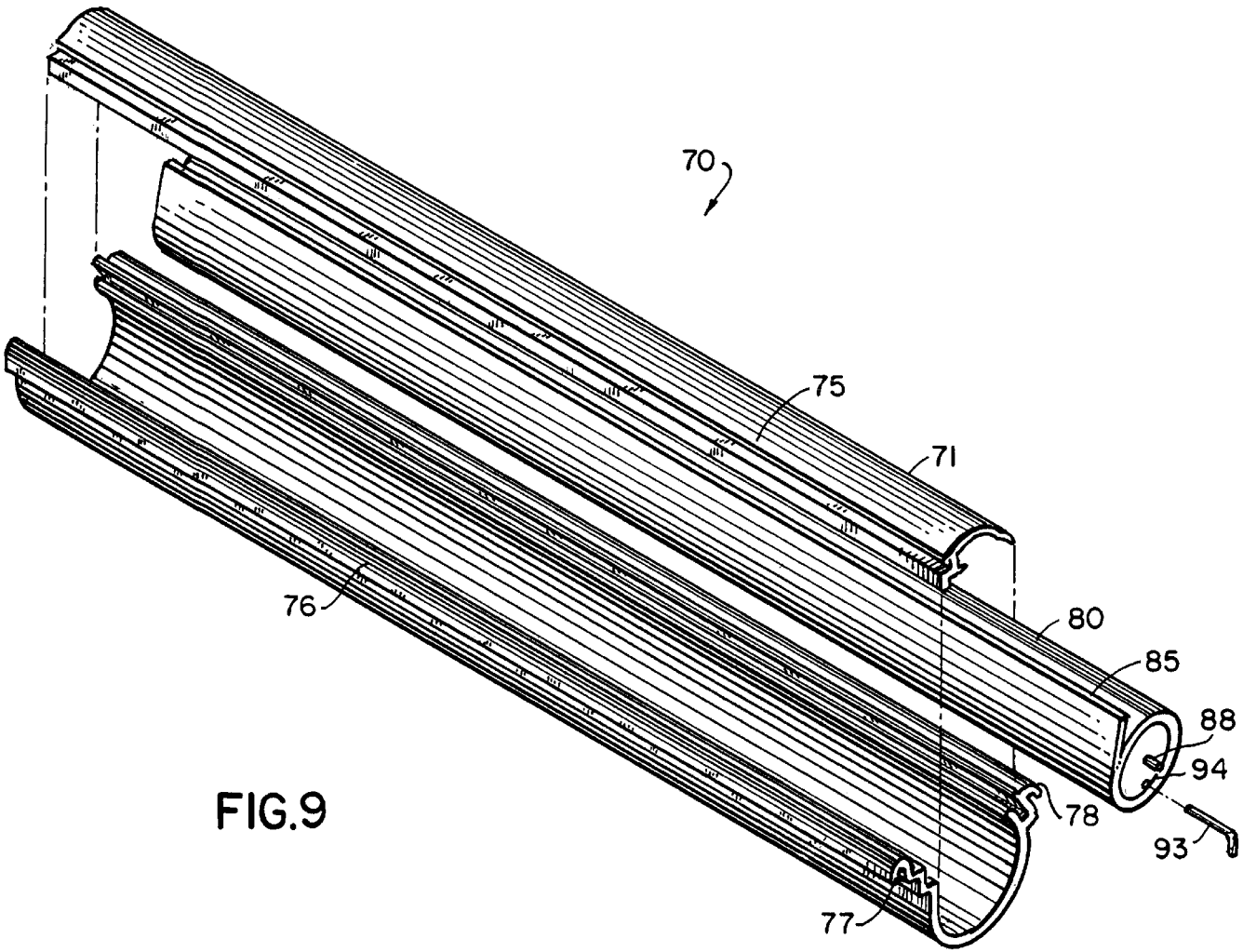
FIG. 9 is an exploded view of a cassette for the visual display device of FIG. 1.

In the preferred embodiment shown in FIGS. 8 and 9, cassette 70 has an outer casing 71. Preferably, outer casing 71 has two C-shaped cylindrical pieces 75 and 76. In this preferred embodiment, cassette 70 is tube-shaped. The outer casing 71 is preferably made of a plastic material.

Figure 12:
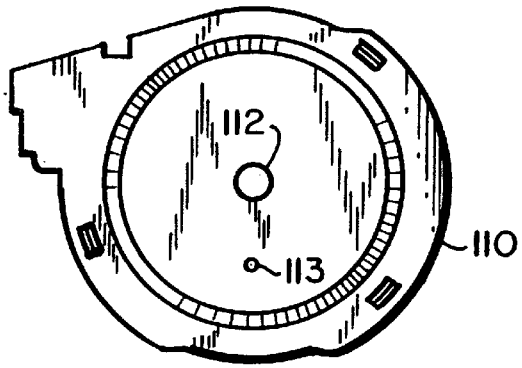
FIG. 12 is a plan view of a second end cap.
Figure 14:
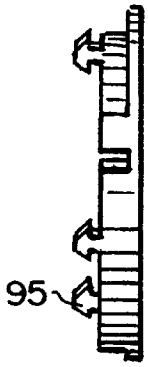
FIG. 14 is an edge view of the first and second end caps.
Figure 13:
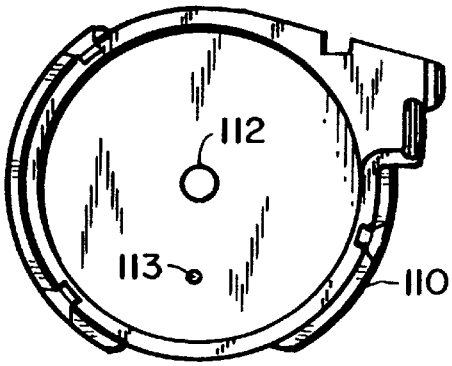
FIG. 13 is a plan view opposite that of FIG. 12 of the second end cap for the cassette of FIG. 8.
Figure 11:
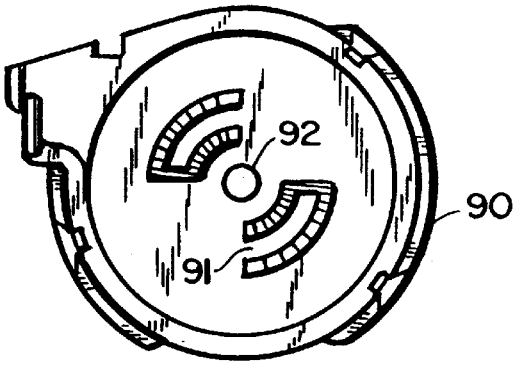
FIG. 11 is a plan view of a first end cap for the cassette of FIG. 8.
Figure 16:
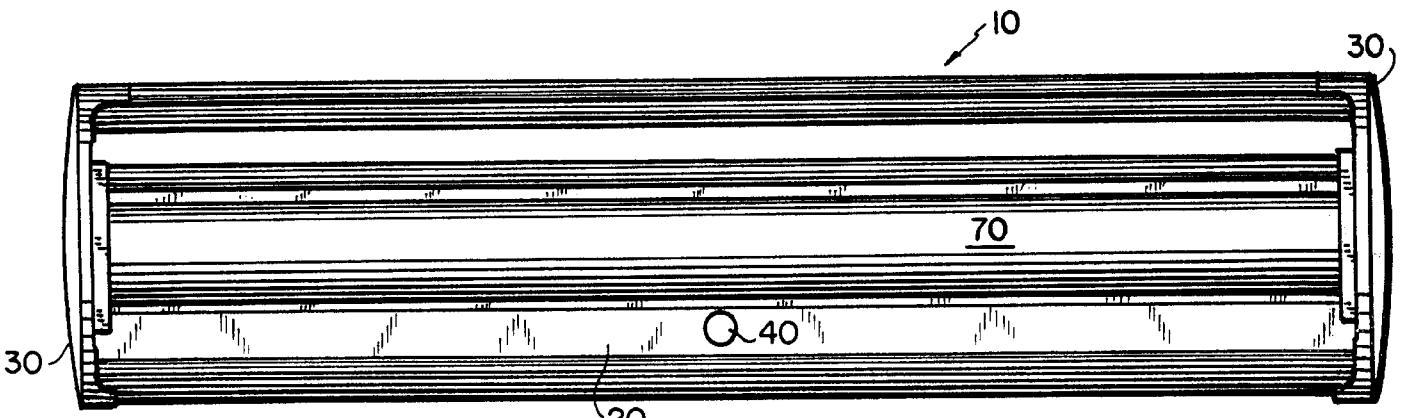
FIG. 16 is a bottom view of the visual display device of FIG. 1, with a cassette inserted.
Figure 17:
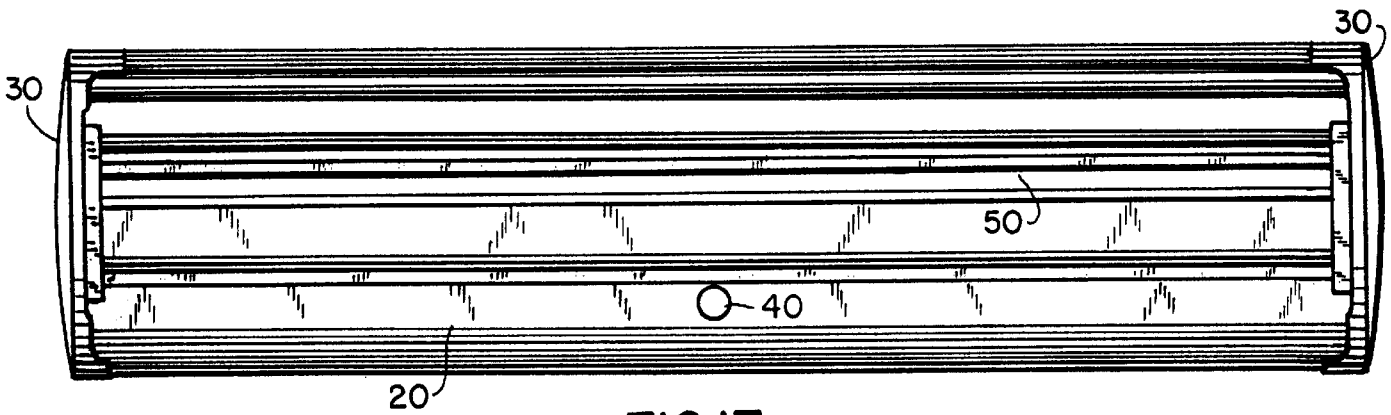
FIG. 17 is a bottom view of the visual display device of FIG. 1, with no cassette inserted.

As shown in FIG. 9, the outer casing has two hook-shaped portions 77 and 78 that latch onto the ridged members 61 and 66 of the interior of holding member 20 shown in FIG. 4, thereby securing cassette 70 in place in the holding member. Cassette 70 preferably has two end caps 90 and 110, shown in FIGS. 8, 12 and 13, and 10 and 11 respectively. Each end cap 90, 110 is located at either end of the tube-shaped cassette 70. Referring to FIG. 14, end caps 90 and 110 are connected to outer casing 71 of cassette 70 via several hook snaps 95 that fasten into holes 79 located in the ends of outer casing 71 as shown in FIG. 4. End caps 90 and 110 also have center holes 92 and 112, respectively, as shown in FIGS. 11 and 13, respectively.

The outer casing 71 of cassette 70 encloses a biased spindle device 80. As shown in FIGS. 4 and 9, biased spindle device 80 is preferably a standard spring-loaded spindle, substantially similar to the devices utilized with standard retractable home window shades. In the preferred embodiment, biased spindle device 80 is longitudinally centered in cassette member 70. As shown in FIG. 9, one end of biased spindle device 80 preferably has a central embossment 88 and a hole 94 designed to fit stop pin 93. As shown in FIG. 12, end cap 110 has a center hole 112 and a hole 113. Central embossment 88 fits into hole 112 and aids in centering biased spindle device 80 in outer casing 71. Hole 113 of end cap 110 aligns with hole 94 of biased spindle device 80. Stop pin 93 may be inserted through hole 113 and hole 94 to maintain the tension in biased spindle device 80. Removal of stop pin 93 results in release of the tension.

As shown in FIG. 4, the other end of biased spindle device 80 preferably has an embossment 87 that is connected to an inner cylinder 89 of biased spindle device 80. The tension in biased spindle device 80 is adjusted by the rotation of inner cylinder 89. Preferably, a slotted disc 100 is placed between the end of biased spindle device 80 and end cap 90. Disc 100 has a central hole 102 that fits over embossment 87. Disc 100 also has raised grooves 105 that correspond to slots 91 on the interior of end cap 90. Once assembled, embossment 87 passes through hole 102 and into hole 92.

In the preferred embodiment shown in FIG. 9, a short leader banner 85 is attached to biased spindle device 80. In this preferred embodiment, when visual display device 10 is assembled, leader banner 85 passes through an opening 72 as shown in FIG. 4, in outer casing 71 of cassette 70, as well as opening 50 of holding member 20. In the preferred embodiment, a banner, photomural display panel or other visual display media 55 is connected to leader banner 85 by connecting the banner, photomural display panel or other visual display media 55 to a strip of adhesive material located on an edge of leader banner 85. Once connected to leader banner 85, the banner, photomural display panel or other visual display media 55, can be retracted into or extended out of cassette 70. Preferably, the opposite end of the banner, photomural display panel or other visual display media 55 can be connected to a rod that can be connected to the end of a pole 45 using a hook.

As shown in FIGS. 1 and 15 to 17, an orifice 40 is located in holding member 20 through second portion 26. In the preferred embodiment shown in FIG. 15, there is preferably a rigid cup-like receptacle 47 that extends vertically through orifice 40. When fully assembled, as shown in FIGS. 2 and 3, a pole 45 can be inserted into receptacle 47 in orifice 40. Once cassette 70 is inserted into holding member 20, a banner, photomural display panel or other visual display media 55 that has been previously attached to leader banner 85 can be extended and fastened to the top of pole 45 by any conventional connecting mechanism and displayed in this fashion. The banner, photomural display panel or other visual display media 55 can also be disengaged from pole 45 and retracted back into cassette 70. Pole 45 can then be removed and visual display device 10 can be easily transported. For portability purposes, a collapsible pole can be used.

The present invention having been thus been described with particular reference to the preferred forms thereof, it will be obvious that various changes and modifications may be made therein without departing from the spirit and scope of the present invention as defined in the appended claims.

What is claimed is:

1. A visual display device comprising:

a holding member;

a cassette adapted to be inserted into and removed from said holding member, said cassette for receiving a display media and permitting movement of the display media from a closed position to an open, visual position, said cassette having an opening for retracting the display media into said cassette and for extending the display media out of said cassette;

a mechanism for removably positioning said cassette into said holding member; and a second mechanism for maintaining the display media in the open position.

2. The visual display device of claim 1, wherein said holding member includes at least one removable side covering.

3. The visual display device of claim 2, wherein said at least one removable side covering is removably connected to said holding member.

4. The visual display device of claim 1, wherein said second mechanism is a pole.

5. The visual display device of claim 1, wherein said cassette includes an outer casing and an inner biased spindle.

6. The visual display device of claim 5, wherein said outer casing includes at least one end cap, which holds said inner biased spindle centered in said outer casing.

7. The visual display device of claim 6, wherein said at least one end cap includes a mechanism that holds in position the biased spindle.

8. The visual display device of claim 5, wherein said inner biased spindle includes means for positioning the display media in said cassette.

9. The visual display device of claim 5, wherein said outer casing of said cassette has an opening for loading and unloading the display media.

10. The visual display device of claim 1, wherein said holding member has an opening through which can pass the display media.

11. The visual display device of claim 10, wherein the visual display media can be extended from the display device, and the display media can be connected to said second mechanism.

12. A cassette for holding a banner, photomural display panel or other visual display media and adapted to be removably positioned into a visual display device comprising:

an outer casing; and an inner biased spindle, wherein said cassette has an opening for retracting the display media into said cassette and for extending the display media out of said cassette.

13. The cassette of claim 12, wherein said outer casing includes at least one end cap, which serves to hold said inner biased spindle centered in said outer casing.

14. The cassette of claim 13, wherein said at least one end cap includes a mechanism that holds in position the biased spindle.

15. The cassette of claim 12, wherein said inner biased spindle includes means for positioning the display media in the cassette.

16. The cassette of claim 13, wherein said outer casing has an opening for loading and unloading the display media.

17. The cassette of claim 13, wherein said cassette can be inserted into a holding member of the display device.

18. The cassette of claim 13, wherein said outer casing is made from at least two substrates.

19. The cassette of claim 12, wherein said outer casing includes a mechanism for connecting the cassette to a holding member.

20. A method for displaying visual display media comprising:

loading the visual display media into a cassette, said cassette having an opening for retracting the display media into said cassette and for extending the display media out of said cassette;

inserting the cassette into a holding member;

connecting a pole at a first end position to the holding member; and extending the visual display media and securing an end of the visual display to a second end position, opposite the first end position, of the pole.

21. The method of claim 20, wherein the visual display media is connected to a biased spindle located inside said cassette.

22. The method of claim 20, wherein the visual display media is extended from the holding member and fastened onto the pole by a fastener.

23. A visual display device comprising:

a holding member having an opening;

a cassette adapted to be inserted into and removed from said holding member, said cassette for receiving a display media and permitting movement of the display media from a closed position to an open, visual position, said cassette having an outer casing and an inner biased spindle, said cassette having a leader sheet adapted to be removably connected to the display media, said cassette having an opening for retracting said leader sheet and the display media into said cassette and for extending said leader sheet and the display media out of said cassette;

a mechanism for removably positioning said cassette into said holding member; and a second mechanism for maintaining the display media in the open position.

24. The visual display device of claim 23, wherein the holding member opening positionally corresponds to the cassette opening.

25. The visual display device of claim 23, wherein the display media is removably connected to said leader sheet by an adhesive.

26. The visual display device of claim 23, wherein said second mechanism is a pole.

27. The visual display device of claim 23, wherein said leader sheet is connected to said inner biased spindle and removably connected to the display media.

* * * * *